US012250983B1

(12) United States Patent
Qian

(10) Patent No.: US 12,250,983 B1
(45) Date of Patent: Mar. 18, 2025

(54) BUCKLE TYPE EARMUFF

(71) Applicant: Ningbo Huaqia Electronic Technology Co., Ltd., Ningbo (CN)

(72) Inventor: Hongyan Qian, Ningbo (CN)

(73) Assignee: Ningbo Huaqia Electronic Technology Co., Ltd., Ningbo (CN)

( * ) Notice: Subject to any disclaimer, the term of this patent is extended or adjusted under 35 U.S.C. 154(b) by 0 days.

(21) Appl. No.: 18/739,881

(22) Filed: Jun. 11, 2024

(30) Foreign Application Priority Data

Jan. 10, 2024 (CN) ..... 202420054323.8

(51) Int. Cl.
*A42B 7/00* (2006.01)
*A42B 1/0188* (2021.01)

(52) U.S. Cl.
CPC ..... *A42B 7/00* (2013.01); *A42B 1/0188* (2021.01)

(58) Field of Classification Search
CPC ..... A42B 3/16; A42B 3/163; A42B 3/166; A61F 11/14
See application file for complete search history.

(56) References Cited

U.S. PATENT DOCUMENTS 2,314,782 A * 3/1943 Goretsky ..... A61F 11/06 D29/112
11,241,056 B2 * 2/2022 Bell ..... A61F 11/14
12,004,924 B2 * 6/2024 Himuro ..... H04R 1/10

FOREIGN PATENT DOCUMENTS

CN 205647891 U 10/2016
CN 106344266 A 1/2017
CN 209283438 U 8/2019
CN 216905232 U 7/2022

* cited by examiner

*Primary Examiner* — Katherine M Moran
(74) *Attorney, Agent, or Firm* — George D. Morgan

(57) ABSTRACT

The present utility model discloses a buckle type earmuff, comprising two ear-wrapping covers with connecting buckle plates on their outer side walls and a wearing band mounted between the two connecting buckle plates. Embodiment 1: when worn by an adult, the distance on the elastic plate can be adjusted by pulling the two connecting buckle plates. After adjustment, the clamping block and buckle secure the two ear-wrapping covers to the connecting buckle plates, making it ready for use. Embodiment 2: when used by a kid, Adjust the size of the band ring formed by the elastic. After adjustment, both support housings are buckled onto the adjusted elastic band along with their respective main bodies of buckle plates. This allows the elastic to wrap around the forehead and back of the child's head.

5 Claims, 5 Drawing Sheets

BUCKLE TYPE EARMUFF

CROSS-REFERENCE TO RELATED APPLICATIONS

The application claims priority to Chinese patent application No. 2024200543238, filed on Jan. 10, 2024, the entire contents of which are incorporated herein by reference.

TECHNICAL FIELD

The present utility model relates to the technical field of earmuffs, and in particular, to a buckle type earmuff.

BACKGROUND

In a cold winter, people often wear earmuffs to protect their ears and prevent frostbite. Many existing earmuffs are elastic plate type earmuffs, which are very suitable for adults to wear, however, for some young children, the such earmuffs are relatively low in wearing stability and easy to fall off, so that it is often necessary to use a fixed band type earmuff. However, the existing earmuffs cannot be converted, so that it is difficult to meet the use of different people, and therefore, a buckle type earmuff is proposed.

SUMMARY OF THE UTILITY MODEL

The present utility model is intended to provide a buckle type earmuff to solve the problems raised in the above background art.

To achieve the foregoing objective, the present utility model provides the following technical solution: a buckle type earmuff, including two ear-wrapping covers, where a connecting buckle plate is buckled to an outer side wall of each of the ear-wrapping covers, and a wearing band is mounted between the two connecting buckle plates.

Preferably, the ear-wrapping cover includes a support housing, a silica gel ring is fixedly mounted on an outer edge of an inner end surface of the support housing, a cotton pad is fixedly mounted on the inner end surface of the support housing and is surrounded by the silica gel ring, an embedding groove is formed in an upper end and a lower end of the support housing, a clamping block is fixedly mounted on an inner side wall of the embedding groove, and an outer end surface of the support housing is integrally formed with a limiting protrusion. When an adult wears the buckle type earmuff, the inner end surface of the support housing is closer to an ear of the adult than the outer end surface of the support housing.

Preferably, the connecting buckle plate includes a buckle plate housing, an upper end and a lower end of the buckle plate housing are both integrally formed with an extension plate, the extension plate is sleeved on the embedding groove, a buckle is fixedly mounted on the extension plate, the buckle is clamped to the clamping block, the left and right ends of a surface of the buckle plate housing opposite to the support housing are both integrally formed with a matching limiting protrusion, the limiting protrusion and the matching limiting protrusion are limited, and a middle part of an outer end surface of the buckle plate housing is integrally formed with an insertion sleeve.

Preferably, the wearing band includes an elastic plate, a silica gel sleeve is fixedly mounted at an upper end of an outer side wall of the elastic plate, opposite surfaces of two ends of a lower side of the elastic plate are both uniformly and integrally formed with an extrusion protrusion, the elastic plate is inserted into the insertion sleeve, and the extrusion protrusion is extruded with an inner side wall of the insertion sleeve.

Preferably, the connecting buckle plate includes a main body of a buckle plate, an upper end and a lower end of the main body of the buckle plate are both integrally formed with a connecting plate, the connecting plate is sleeved with the embedding groove, a matching clamping block is integrally formed on the connecting plate, the matching clamping block is clamped with the clamping block, two sides of an opposite surface of the main body of the buckle plate and the support housing are integrally formed with an extrusion protrusion, the extrusion protrusion is matched with the limiting protrusion, and a middle part of an opposite surface of the main body of the buckle plate and the support housing is integrally formed with an extrusion beam.

Preferably, the wearing band includes an elastic band, anti-skid silica gel particles are uniformly and fixedly mounted on an attaching surface of the elastic band and a skin, a cotton pad sheet is fixedly mounted at a lower end of the attaching surface of the elastic band and the skin, and the elastic band is extruded with the extrusion beam, the extrusion protrusion and the limiting protrusion.

The present utility model has the following beneficial effects:

Embodiment 1: when worn by an adult, the distance on the elastic plate can be adjusted by pulling the two connecting buckle plates. After adjustment, the clamping block and buckle secure the two ear-wrapping covers to the connecting buckle plates, making it ready for use.

Embodiment 2: when used by a kid, adjust the size of the band ring formed by the elastic band. After adjustment, both support housings are buckled onto the adjusted elastic band along with their respective main bodies of buckle plates. This allows the elastic band to wrap around the forehead of the child, so that the cotton pad sheet is attached to the back of the child's head.

Therefore, in the present utility model, the earmuff can perform fixed band type and elastic plate type conversion, facilitating the use of different people.

Figure 1:
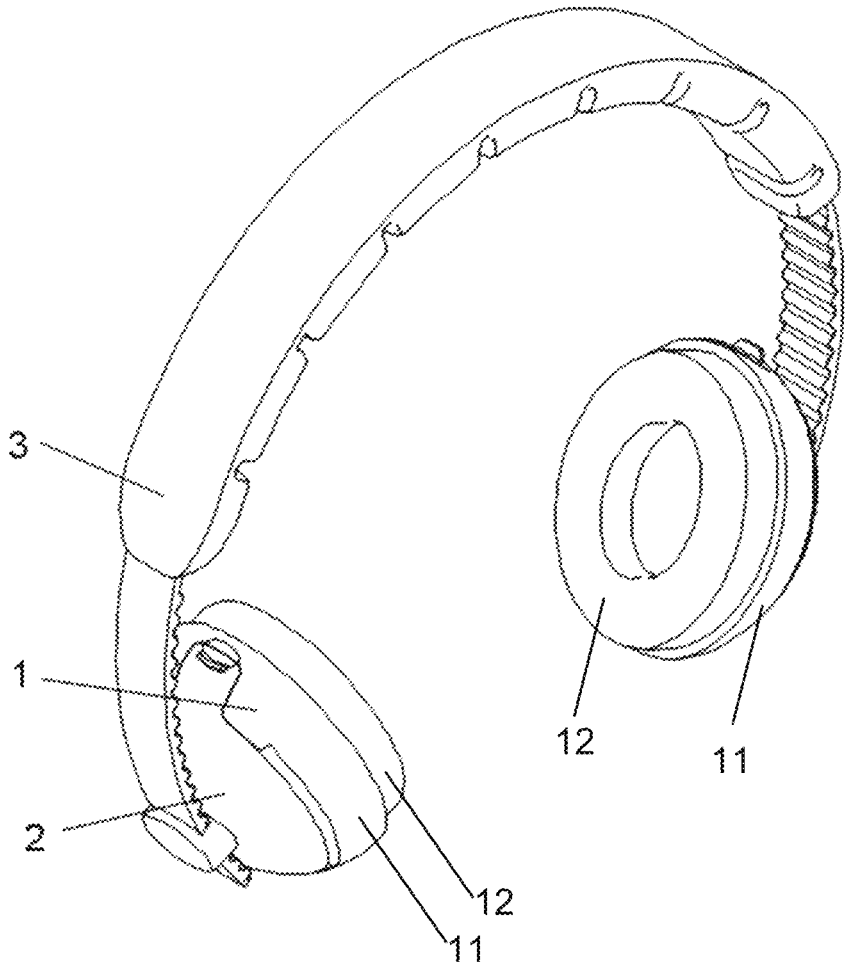
FIG. 1 is a schematic structural diagram of the present utility model.

In the figures: ear-wrapping cover 1, support housing 11, silica gel ring 12, cotton pad 13, embedding groove 14, clamping block 15, limiting protrusion 16, connecting buckle plate 2, buckle plate housing 21, extension plate 22, buckle 23, matching limiting protrusion 24, insertion sleeve 25, main body 201 of buckle plate, connecting plate 202, matching clamping block 203, extrusion protrusion 204, extrusion beam 205, wearing band 3, elastic plate 31, silica gel sleeve 32, extrusion protrusion 33, elastic band 301, anti-skid silica gel particle 302, cotton pad sheet 303.

DETAILED DESCRIPTION OF THE EMBODIMENTS

The following clearly and completely describes the technical solutions in the embodiments of the utility model with reference to the accompanying drawings in the embodiments of the utility model. Apparently, the described embodiments are only a part rather than all of the embodiments of the utility model. All other embodiments obtained by a person of ordinary skill in the art based on the embodiments of the present utility model without creative efforts shall fall within the protection scope of the present utility model.

Embodiment 1

Figure 2:
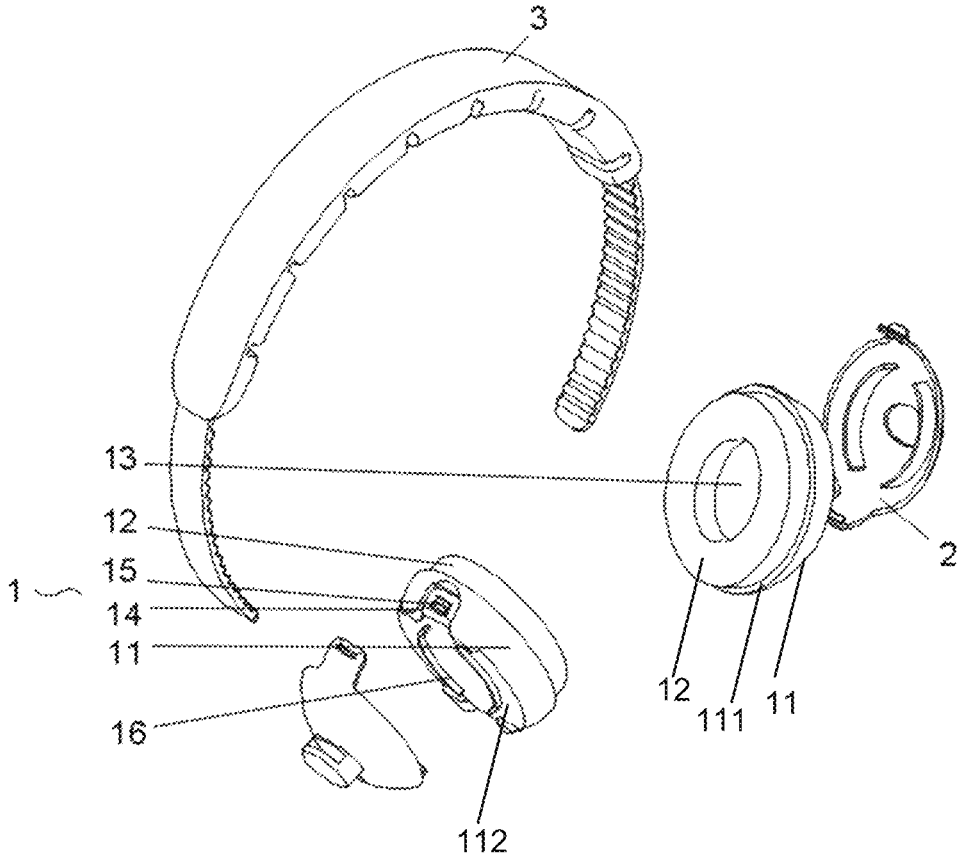
FIG. 2 is a schematic exploded view of a part of the structure of the present utility model.
Figure 3:
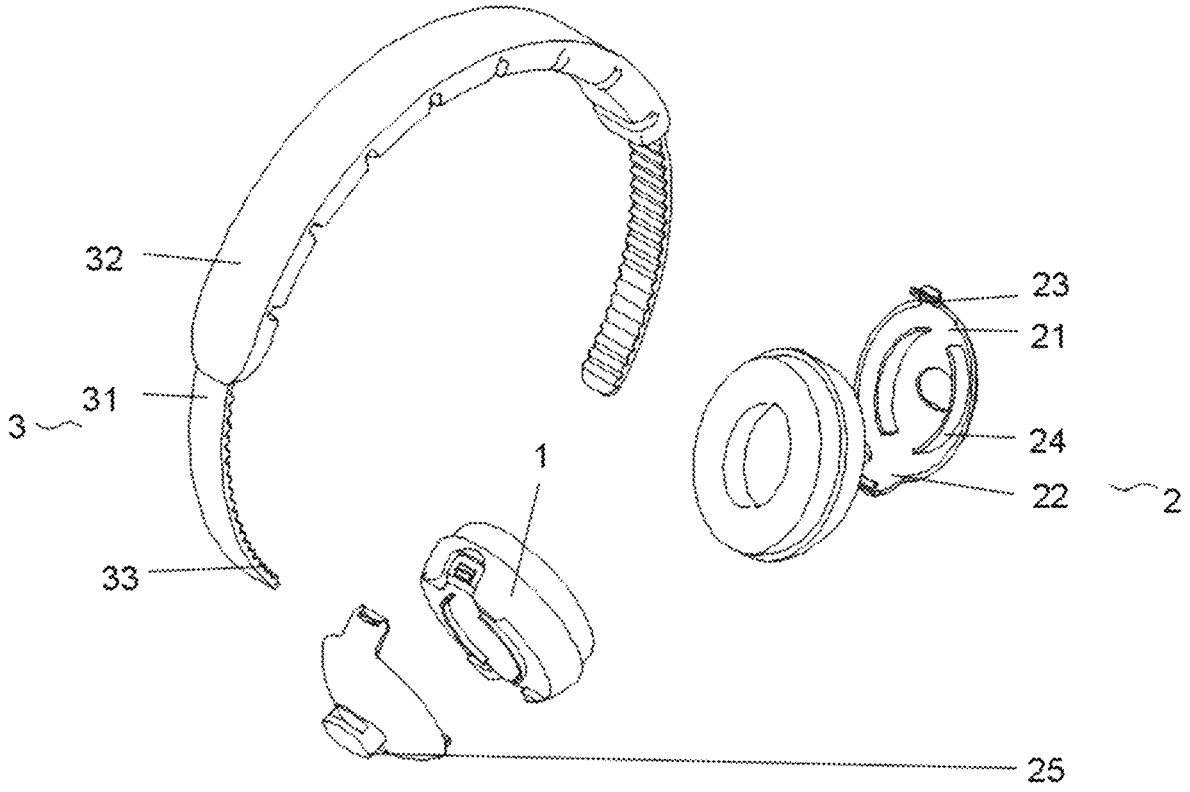
FIG. 3 is a schematic exploded view of a structure of Embodiment 1 of the present utility model.
Figure 4:
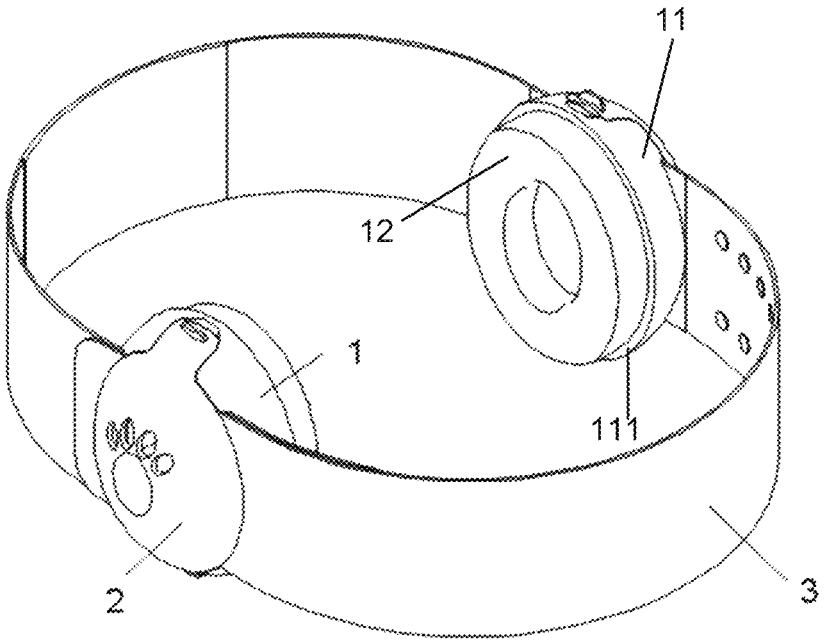
FIG. 4 is a schematic diagram of a structure of Embodiment 2 of the present utility model.
Figure 5:
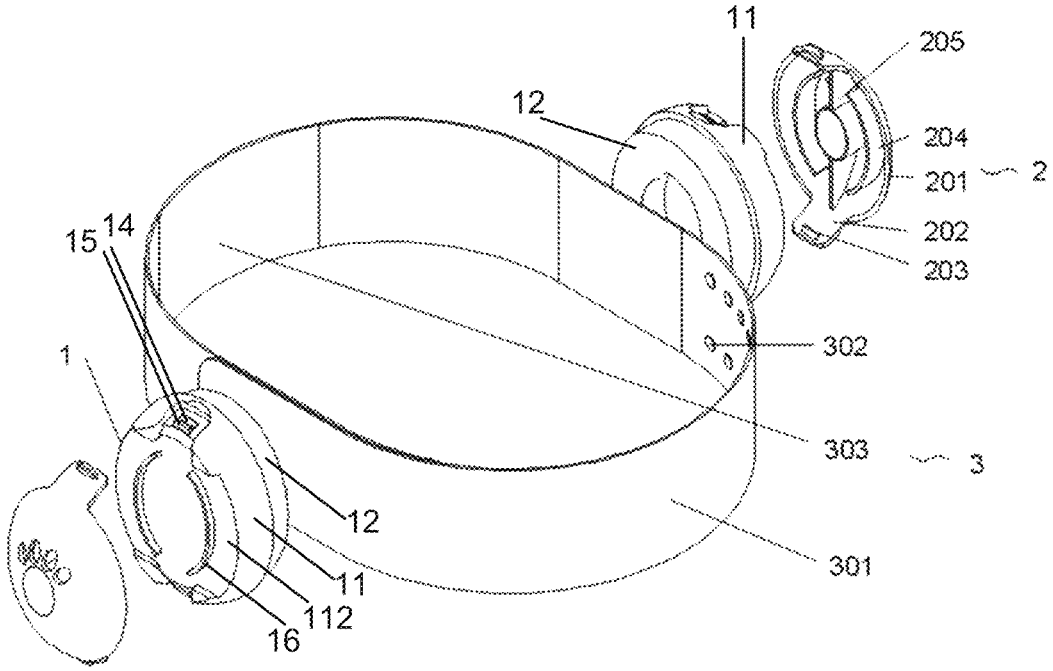
FIG. 5 is a schematic exploded view of a structure of Embodiment 2 of the present utility model.

Referring the FIG. 1 to FIG. 3, the present utility model provides a technical solution: a buckle type earmuff, including two ear-wrapping covers 1, where a connecting buckle plate 2 is buckled to an outer side wall of each of the ear-wrapping covers 1, and a wearing band 3 is mounted between the two connecting buckle plates 2.

Specifically, the ear-wrapping cover 1 includes a support housing 11, a silica gel ring 12 is fixedly mounted on an outer edge of an inner end surface 111 of the support housing 11, a cotton pad 13 is fixedly mounted on the inner end surface 111 of the support housing 11 and is surrounded by the silica gel ring 12, an embedding groove 14 is formed in an upper end and a lower end of the support housing 11, a clamping block 15 is fixedly mounted on an inner side wall of the embedding groove 14, and an outer end surface 112 of the support housing 11 is integrally formed with a limiting protrusion 16. When an adult wears the buckle type earmuff, the inner end surface 111 of the support housing 11 is closer to an ear of the adult than the outer end surface 112 of the support housing 11.

Specifically, the connecting buckle plate 2 includes a buckle plate housing 21, an upper end and a lower end of the buckle plate housing 21 are both integrally formed with an extension plate 22, the extension plate 22 is sleeved with the embedding groove 14, a buckle 23 is fixedly mounted on the extension plate 22, the buckle 23 is clamped with the clamping block 15, left and right ends of an opposite surface of the buckle plate housing 21 and the support housing 11 are both integrally formed with a matching limiting protrusion 24, the limiting protrusion 16 and the matching limiting protrusion 24 are limited to each other, and a middle part of an outer end surface of the buckle plate housing 21 is integrally formed with an insertion sleeve 25.

Specifically, the wearing band 3 includes an elastic plate 31, a silica gel sleeve 32 is fixedly mounted at an upper end of an outer side wall of the elastic plate 31, opposite surfaces of two ends of a lower side of the elastic plate 31 are both uniformly and integrally formed with an extrusion protrusion 33, the elastic plate 31 is inserted into the insertion sleeve 25, and the extrusion protrusion 33 is extruded with an inner side wall of the insertion sleeve 25.

The wearing band 3 has a plurality of different colors, and the elastic plate 31 can be pulled out of the insertion sleeve 25 to replace the wearing band according to the preference of people.

Working principles: when worn by an adult, the distance on the elastic plate 31 can be adjusted by pulling the two connecting buckle plates 2. After adjustment, the clamping block 15 and buckle 23 secure the two ear-wrapping covers 1 to the connecting buckle plates 2, making it ready for use.

Embodiment 2

A buckle type earmuff, with other features being the same as in Embodiment 1, differs in that: as shown in FIG. 1 to FIG. 2 and FIG. 4 to FIG. 5:

Specifically, the connecting buckle plate 2 includes a main body 201 of a buckle plate, an upper end and a lower end of the main body 201 of the buckle plate are both integrally formed with a connecting plate 202, the connecting plate 202 is sleeved with the embedding groove 14, a matching clamping block 203 is integrally formed on the connecting plate 202, the matching clamping block 203 is clamped with the clamping block 15, two sides of an opposite surface of the main body 201 of the buckle plate and the support housing 11 are integrally formed with an extrusion protrusion 204, the extrusion protrusion 204 is matched with the limiting protrusion 16, and a middle part of an opposite surface of the main body 201 of the buckle plate and the support housing 11 is integrally formed with an extrusion beam 205.

Specifically, the wearing band 3 includes an elastic band 301, anti-skid silica gel particles 302 are uniformly and fixedly mounted on an attaching surface of the elastic band 301 and a skin, a cotton pad sheet 303 is fixedly mounted at a lower end of the attaching surface of the elastic band 301 and the skin, and the elastic band 301 is extruded with the extrusion beam 205, the extrusion protrusion 204 and the limiting protrusion 16.

Working principles: when used by a kid, adjust the size of the band ring formed by the elastic band 301. After adjustment, both support housings 11 are buckled onto the adjusted elastic band 301 along with their respective main bodies 201 of buckle plates (one set of the main body and the support housing is buckled at an attaching position of two ends of the elastic band 301). This allows the elastic band to wrap around the forehead of the child, so that the cotton pad sheet is attached to the back of the child's head. Therefore, in the present utility model, earmuff can perform fixed band type and elastic plate type conversion, facilitating the use of different people.

Although embodiments of the present utility model have been shown and described, it may be understood by those of ordinary skill in the art that, without departing from the principles and spirit of the present utility model, various changes, modifications, replacements, and variations may be made to these embodiments, and the scope of the present utility model is limited by the appended claims and equivalents thereof.

What is claimed is:

1. A buckle type earmuff, comprising two ear-wrapping covers (1), wherein a connecting buckle plate (2) is buckled to an outer side wall of each of the ear-wrapping covers (1), and a wearing band (3) is mounted between the two connecting buckle plates (2), and wherein the ear-wrapping cover (1) comprises a support housing (11), a silica gel ring (12) is fixedly mounted on an outer edge of an inner end surface of the support housing (11), a cotton pad (13) is fixedly mounted on the inner end surface of the support housing (11) and surrounded by the silica gel ring (12), each of an upper end and a lower end of the support housing (11) is provided with an embedding groove (14), a clamping block (15) is fixedly mounted on an inner side wall of the embedding groove (14), and an outer end surface of the support housing (11) is integrally formed with a limiting protrusion (16), and wherein, when an adult wears the buckle type earmuff, the inner end surface of the support housing (11) is closer to an ear of the adult than the outer end surface of the support housing (11).

2. The buckle type earmuff according to claim 1, wherein the connecting buckle plate (2) comprises a buckle plate housing (21), an upper end and a lower end of the buckle plate housing (21) are both integrally formed with an extension plate (22), the extension plate (22) is sleeved with the embedding groove (14), a buckle (23) is fixedly mounted on the extension plate (22), the buckle (23) is clamped with the clamping block (15), left and right ends of an opposite surface of the buckle plate housing (21) and the support housing (11) are both integrally formed with a matching limiting protrusion (24), and a middle part of an outer end surface of the buckle plate housing (21) is integrally formed with an insertion sleeve (25).

3. The buckle type earmuff according to claim 2, wherein the wearing band (3) comprises an elastic plate (31), a silica gel sleeve (32) is fixedly mounted at an upper end of an outer side wall of the elastic plate (31), opposite surfaces of two ends of a lower side of the elastic plate (31) are both uniformly and integrally formed with an extrusion protrusion (33), the elastic plate (31) is inserted into the insertion sleeve (25), and the extrusion protrusion (33) abuts against an inner side wall of the insertion sleeve (25).

4. The buckle type earmuff according to claim 1, wherein the connecting buckle plate (2) comprises a main body (201) of a buckle plate, an upper end and a lower end of the main body (201) of the buckle plate are both integrally formed with a connecting plate (202), the connecting plate (202) is sleeved with the embedding groove (14), a matching clamping block (203) is integrally formed on the connecting plate (202), the matching clamping block (203) is clamped with the clamping block (15), two sides of an opposite surface of the main body (201) of the buckle plate and the support housing (11) are integrally formed with an extrusion protrusion (204), the extrusion protrusion (204) is matched with the limiting protrusion (16), and a middle part of an opposite surface of the main body (201) of the buckle plate and the support housing (11) is integrally formed with an extrusion beam (205).

5. The buckle type earmuff according to claim 4, wherein the wearing band (3) comprises an elastic band (301), anti-skid silica gel particles (302) are uniformly and fixedly mounted on an attaching surface of the elastic band (301) and a skin, a cotton pad sheet (303) is fixedly mounted at a lower end of the attaching surface of the elastic band (301) and the skin, and the elastic band (301) is extruded with the extrusion beam (205), the extrusion protrusion (204) and the limiting protrusion (16).

* * * * *